US011386839B2

(12) United States Patent
Aurongzeb et al.

(10) Patent No.: US 11,386,839 B2
(45) Date of Patent: Jul. 12, 2022

(54) SYSTEMS AND METHODS FOR MANAGEMENT OF ORGANIC LIGHT-EMITTING DIODE DISPLAY DEGRADATION

(71) Applicant: Dell Products L.P., Round Rock, TX (US)

(72) Inventors: Deeder M. Aurongzeb, Austin, TX (US); Philip Conde, Austin, TX (US); Nick Luna, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/910,571

(22) Filed: Jun. 24, 2020

(65) Prior Publication Data

US 2021/0407410 A1 Dec. 30, 2021

(51) Int. Cl.
*G09G 3/3233* (2016.01)

(52) U.S. Cl.
CPC ... *G09G 3/3233* (2013.01); *G09G 2320/0233* (2013.01); *G09G 2320/0242* (2013.01); *G09G 2320/041* (2013.01); *G09G 2320/0693* (2013.01); *G09G 2360/145* (2013.01)

(58) Field of Classification Search
CPC ..... G09G 3/3233; G09G 2320/0693; G09G 2320/041; G09G 2320/0233; G09G 2320/0242; G09G 2360/145
See application file for complete search history.

(56) References Cited

U.S. PATENT DOCUMENTS

2013/0027383 A1* 1/2013 Odawara ..... G09G 3/3233 345/212
2013/0135272 A1* 5/2013 Park ..... G09G 3/3233 345/211
2013/0249930 A1* 9/2013 Kim ..... G09G 3/30 345/589
2014/0218345 A1* 8/2014 Matsuura ..... G09G 3/3426 345/207
2015/0187283 A1* 7/2015 Jiang ..... G09G 3/342 345/690
2017/0069274 A1* 3/2017 Park ..... G09G 3/3406
2017/0103694 A1* 4/2017 Kim ..... G09G 3/006
2017/0309213 A1* 10/2017 Roh ..... G09G 3/2003
2020/0135101 A1* 4/2020 Yamaguchi ..... G09G 3/3233
2020/0152142 A1* 5/2020 Kim ..... G09G 3/3607

* cited by examiner

*Primary Examiner* — Jeff Piziali
(74) *Attorney, Agent, or Firm* — Jackson Walker L.L.P.

(57) ABSTRACT

An information handling system may include a display comprising an organic light-emitting diode (OLED) panel and an OLED degradation management subsystem configured to, responsive to a condition for initiating a calibration of the OLED panel, logically divide the OLED panel into a plurality of non-overlapping test windows of a defined size, measure a physical quantity for a pixel of at least one of the plurality of non-overlapping test windows to determine a deviation of the at least one test window from a linear degradation profile, and correct for non-linear degradation occurring in the at least one test window based on the deviation.

18 Claims, 3 Drawing Sheets

SYSTEMS AND METHODS FOR MANAGEMENT OF ORGANIC LIGHT-EMITTING DIODE DISPLAY DEGRADATION

TECHNICAL FIELD

The present disclosure relates in general to information handling systems, and more particularly to managing degradation of organic light-emitting diode displays in an information handling system.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Organic light-emitting diode (OLED) displays are increasing in use in information handling systems, televisions, and other video display applications, due to their advantages over more traditional liquid crystal displays. An OLED display, in contrast to a liquid crystal display, operates without a backlight because it emits visible light. Thus, it can display deep black levels and may be thinner and lighter than a liquid crystal display. In low ambient light conditions (e.g., such as a dark room), an OLED screen may achieve a higher contrast ratio than a liquid crystal display.

However, due to the thinner designs of OLED displays, localized thermal conditions within an OLED display may lead to non-homogenous degradation of the OLED display, with some portions suffering a greater loss in luminosity than other portions of the OLED display. Further, when displaying different colors, due to the emissive nature of OLEDs, some colors (e.g., blue) may degrade more than others (e.g., red).

SUMMARY

In accordance with the teachings of the present disclosure, one or more disadvantages and problems associated with managing degradation of organic light-emitting diode displays may be reduced or eliminated.

In accordance with embodiments of the present disclosure, an information handling system may include a display comprising an organic light-emitting diode (OLED) panel and an OLED degradation management subsystem configured to, responsive to a condition for initiating a calibration of the OLED panel, logically divide the OLED panel into a plurality of non-overlapping test windows of a defined size, measure a physical quantity for a pixel of at least one of the plurality of non-overlapping test windows to determine a deviation of the at least one test window from a linear degradation profile, and correct for non-linear degradation occurring in the at least one test window based on the deviation.

In accordance with these and other embodiments of the present disclosure, a method may include logically dividing an organic light-emitting diode (OLED) panel into a plurality of non-overlapping test windows of a defined size, measuring a physical quantity for a pixel of at least one of the plurality of non-overlapping test windows to determine a deviation of the at least one test window from a linear degradation profile, and correcting for non-linear degradation occurring in the at least one test window based on the deviation.

In accordance with these and other embodiments of the present disclosure, an article of manufacture may include a non-transitory computer-readable medium and computer-executable instructions carried on the computer-readable medium, the instructions readable by a processor, the instructions, when read and executed, for causing the processor to, logically divide an organic light-emitting diode (OLED) panel into a plurality of non-overlapping test windows of a defined size, measure a physical quantity for a pixel of at least one of the plurality of non-overlapping test windows to determine a deviation of the at least one test window from a linear degradation profile, and correct for non-linear degradation occurring in the at least one test window based on the deviation.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 4, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a personal digital assistant (PDA), a consumer electronic device, a network storage device, or any other suitable device and may vary in size, shape, performance, functionality, and price. The information handling system may include memory, one or more processing resources such as a central processing unit ("CPU") or hardware or software control logic. Additional components of the information handling system may include one or more storage devices, one or more communications ports for communicating with external devices as well as various input/output ("I/O") devices, such as a keyboard, a mouse, and a video display. The information handling system may also include one or more buses operable to transmit communication between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such as wires, optical fibers, microwaves, radio waves, and other electromagnetic and/or optical carriers; and/or any combination of the foregoing.

For the purposes of this disclosure, information handling resources may broadly refer to any component system, device or apparatus of an information handling system, including without limitation processors, service processors, basic input/output systems (BIOSs), buses, memories, I/O devices and/or interfaces, storage resources, network interfaces, motherboards, and/or any other components and/or elements of an information handling system.

Figure 1:
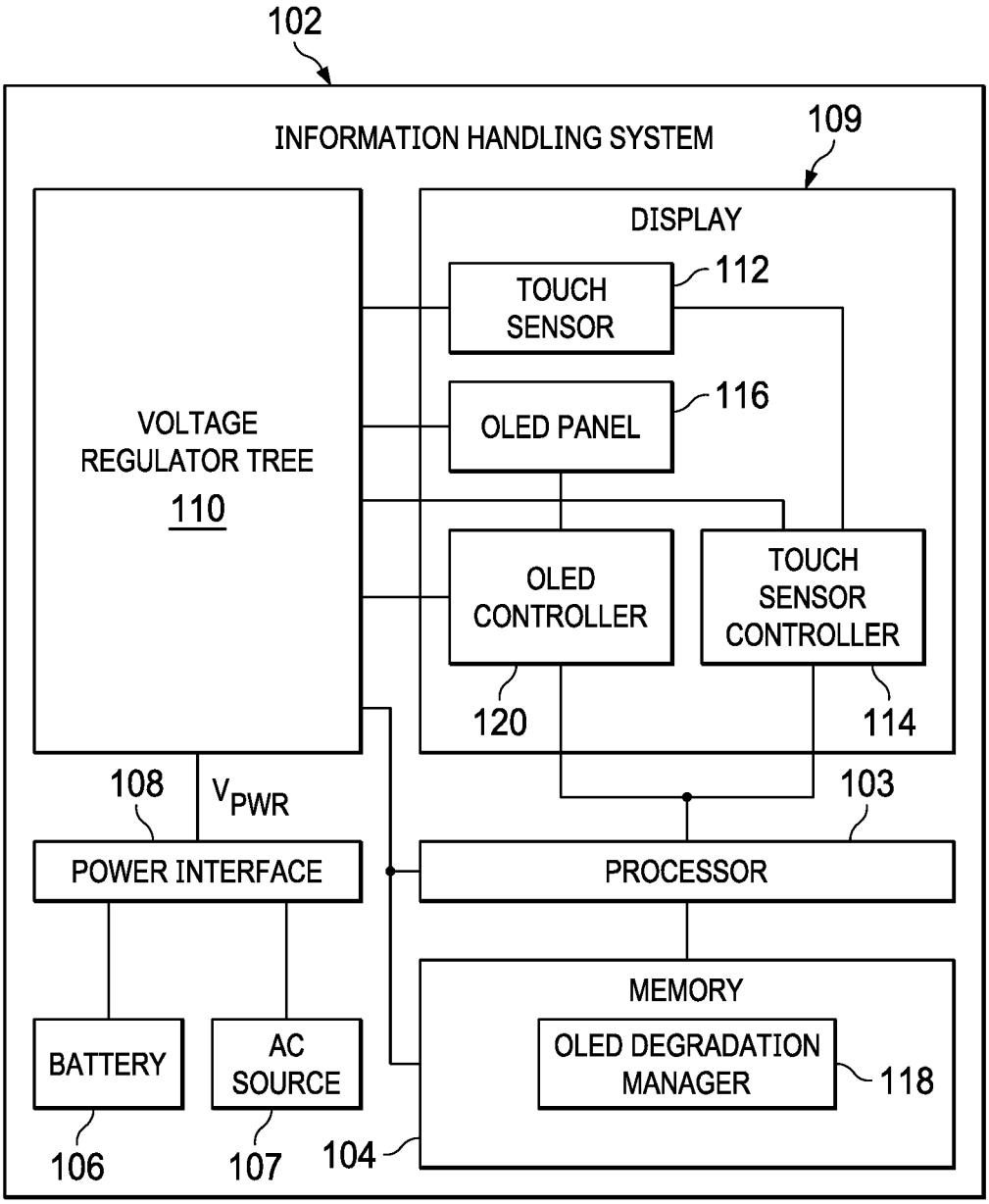
FIG. 1 illustrates a block diagram of an example information handling system, in accordance with certain embodiments of the present disclosure.

FIG. 1 illustrates a block diagram of an example information handling system 102, in accordance with embodiments of the present disclosure. In some embodiments, information handling system 102 may be a mobile device sized and shaped to be readily transported and carried on a person of a user of information handling system 102 (e.g., a notebook or laptop computer, etc.). As depicted in FIG. 1, information handling system 102 may include a processor 103, a memory 104 communicatively coupled to processor 103, a battery 106, an alternating current (AC) source 107, a power interface 108, a display 109, and a voltage regulator tree 110.

Processor 103 may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, processor 103 may interpret and/or execute program instructions and/or process data stored in memory 104 and/or another component of information handling system 102.

Memory 104 may be communicatively coupled to processor 103 and may include any system, device, or apparatus configured to retain program instructions and/or data for a period of time (e.g., computer-readable media). Memory 104 may include RAM, EEPROM, a PCMCIA card, flash memory, magnetic storage, opto-magnetic storage, or any suitable selection and/or array of volatile or non-volatile memory that retains data after power to information handling system 102 is turned off.

As shown in FIG. 1, memory 104 may have stored thereon an OLED degradation manager 118. OLED degradation manager 118 may comprise a program of instructions that may be read and executed by processor 103 to perform management of OLED controller 120 and/or OLED panel 116 to determine a level of degradation of certain portions of OLED panel 116 and to correct for such degradation. In particular, OLED degradation manager 118 may employ a linear model that assumes a linear degradation of individual OLEDs of OLED panel 116 over time, but also corrects such linear adaptation to account for non-linear degradation, as described in greater detail below. In some embodiments, OLED degradation manager 118 may be implemented in firmware or a display driver of display 109. In other embodiments, OLED degradation manager 118 may be implemented as an application configured to execute within an operating system of information handling system 102.

Battery 106 may comprise any system, device, or apparatus configured to store energy which may be used by information handling system 102 to power components of information handling system 102 to perform the functionality thereof. In some embodiments, battery 106 may comprise an electrochemical cell configured to convert stored chemical energy into electrical energy.

AC source 107 may comprise any system, device, or apparatus configured to provide a direct current (DC) power source derived from an AC power source (e.g., an AC adapter configured to receive an AC input and convert such AC input to a DC voltage).

Power interface 108 may comprise any system, device, or apparatus configured to serve as an electrical interface between power sources (e.g., battery 106 and AC source 107) and voltage regulator tree 110. Accordingly, power interface 108 may include any suitable combination of connectors, cabling, cabling harnesses, and/or other components to provide such an electrical interface. In some embodiments, power interface 108 may be configured to, when an AC input is present, output a voltage $V_{PWR}$ which is provided by AC source 107, and when an AC input is not present, output a voltage $V_{PWR}$ which is provided by battery 106, in order to provide electrical energy to components of information handling system 102.

Display 109 may comprise any instrumentality or aggregation of instrumentalities by which a user may interact with information handling system 102. For example, display 109 may permit a user to input data and/or instructions into information handling system 102, and/or otherwise manipulate information handling system 102 and its associated components. Display 109 may also permit information handling system 102 to communicate data to a user, e.g., by way of a display device. In some embodiments, display 109 may comprise a touch-screen display. When implemented as a touch-screen display, display 109 may comprise touch sensor 112, touch sensor controller 114, OLED panel 116, and LED controller 120.

As known in the art, touch sensor 112 may include any system, device, or apparatus configured to detect tactile touches (e.g., by a human finger, a stylus, etc.) on touch sensor 112 and generate one or more signals indicative of the occurrence of such touches and/or the locations of such touches on the touch sensor 112. In some embodiments, touch sensor 112 may be a capacitive touch sensor configured to detect changes in capacitance induced by tactile touches. In these and other embodiments, touch sensor 112 may be constructed from substantially optically transparent material and placed over OLED panel 116 or another display apparatus, allowing a user to view graphical elements of the touch display while interacting with touch sensor 112.

Touch sensor controller 114 may be communicatively coupled between touch sensor 112 and processor 103, and comprise any system, device, or apparatus configured to process signals indicative of touches received from touch sensor 112 and translate such signals into signals which may be processed by processor 103. In addition, touch sensor controller 114 may control one or more operating conditions associated with touch sensor 112, including the rate of sampling touches, whether touch sensor 112 is powered on or enabled, and/or other operating conditions.

OLED panel 116 may comprise any suitable system, device, or apparatus configured to display human-perceptible graphical data and/or alphanumeric data to display 109. As is known in the art, OLED panel 116 may include an array of light-emitting diodes (LED), wherein each LED comprises an emissive electroluminescent layer which is a film of organic compound that emits light in response to an electric current.

OLED controller 120 may be communicatively coupled between OLED panel 116 and processor 103, and may comprise any system, device, or apparatus configured to, based on graphical data communicated from processor 103 to OLED controller 120, control individual LEDs of OLED panel 116 in order to display graphical data and/or alphanumeric data on OLED panel 116.

Voltage regulator tree 110 may comprise any suitable system, device, or apparatus configured to receive a voltage as an input, and generate from such voltage one or more regulated output voltages to power components of information handling system 102 that may have varying input voltage requirements from each other. Accordingly, voltage regulator tree 110 may include one or more direct current-to-direct current voltage converters, including without limitation one or more buck converters, one or more buck-boost converters, and one or more boost converters.

In addition to processor 103, memory 104, battery 106, interface 108, display 109, and voltage regulator tree 110, information handling system 102 may include one or more other information handling resources. An information handling resource may include any component, system, device or apparatus of an information handling system, including without limitation, a processor (e.g., processor 103), bus, memory (e.g., memory 104), I/O device and/or interface, storage resource (e.g., hard disk drives), network interface, electro-mechanical device (e.g., fan), display, power supply, and/or any portion thereof.

In operation, OLED degradation manager 118 may, at defined instances of time, perform a calibration operation wherein OLED panel 116 is divided into a plurality of non-overlapping test windows (e.g., 120 pixels by 120 pixels, 40 pixels by 40 pixels) much smaller than the resolution of OLED panel 116. During the calibration operation, OLED degradation manager 118 may measure a physical quantity (e.g., pixel luminosity) for a pixel of each test window (e.g., bottom-right pixel, randomly-selected pixel, etc.), to determine the test window's deviation, if any, from a linear degradation profile. OLED degradation manager 118 may further correct for the deviation by correcting the linear adaption for each test window. For example, OLED degradation manager 118 may modify a frame buffer for display data to brighten or darken certain areas of an image to account for the non-linear degradation, or may control brightness of OLED panel 116 (e.g., via OLED controller 120), such that each test window of OLED panel 116 displays in accordance with its own brightness level.

Figure 2:
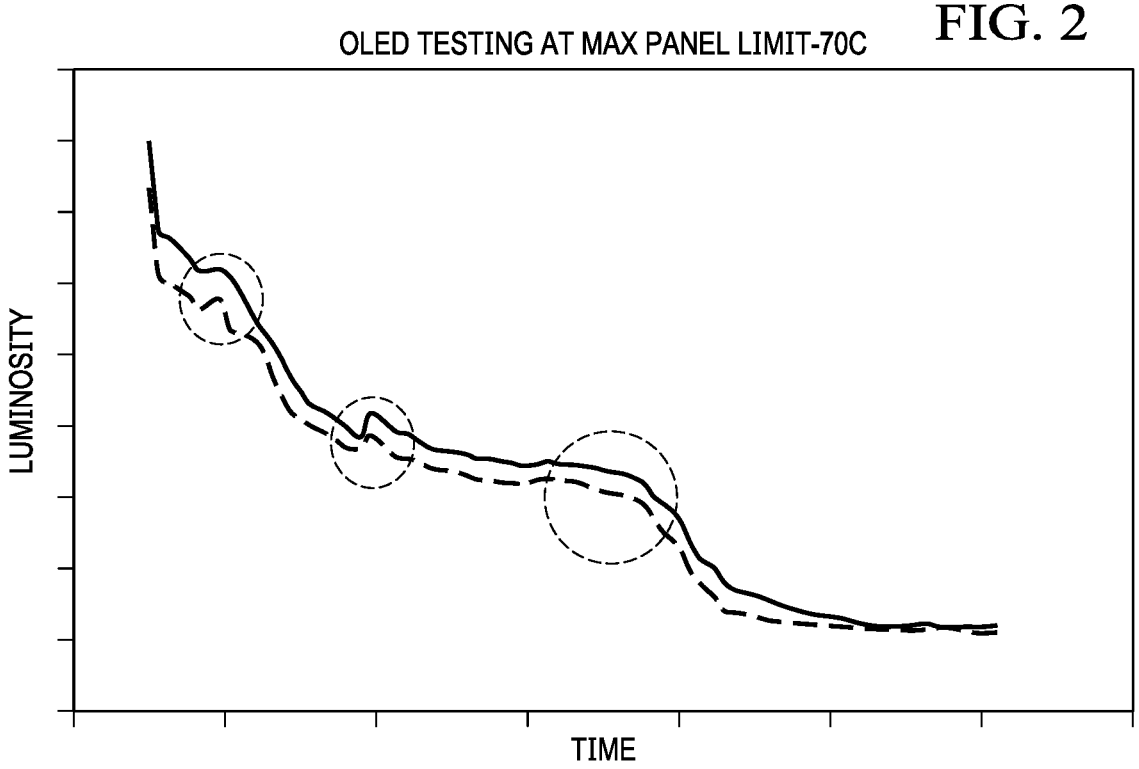
FIG. 2 illustrates an example graph of luminosity versus time over an expected life span of an OLED panel for two different pixels of the OLED panel, in accordance with embodiments of the present disclosure.

To illustrate, FIG. 2 illustrates an example graph of luminosity versus time over an expected life span of OLED panel 116 for two different pixels of OLED panel, in accordance with embodiments of the present disclosure. For example, the solid-line graph may represent luminosity over time for a center pixel of OLED panel 116 while the dashed-line graph may represent luminosity over time for a bottom left corner pixel of OLED panel 116. As shown in FIG. 2, over the lifetime of OLED panel 116, the pixel represented by the dashed-line graph may experience more degradation due to temperature and/or other effects. Accordingly, OLED degradation manager 118 may correct for such non-homogenous degradation by applying different corrections to the respective test windows comprising the pixel represented by the dashed-line graph and the pixel represented by the solid-line graph.

Further, as shown in FIG. 2, degradation of pixels may be highly non-linear, and in some cases, as indicated by circles in FIG. 2, may be non-monotonic with respect to time, with periods of time in which luminosity may increase before again decreasing. Accordingly, existing approaches which assume linear degradation do not accurately track actual degradation, and thus attempts by existing approaches to correct for degradation based on an assumption of linear degradation will fail to correct for such non-linearities and non-monoticities. However, OLED degradation manager 118 may correct for such non-linearities by applying corrections over time that make it appear to a user of OLED panel 116 that degradation is occurring linearly with respect to time.

In some instances, the sizes of test windows may be reduced over the lifetime of display 109, to increase image granularity used to perform calibration over the lifetime of display 109.

The defined instances of time in which OLED degradation manager 118 may initiate a calibration may be defined in any suitable manner, including on a periodic basis (e.g., every three months). In addition to or in lieu of performing calibrations on a periodic basis, OLED degradation manager 118 may limit calibrations to times in which particular conditions are present. For example, due to the fact that calibrations may use significant processing resources, OLED degradation manager 118 may limit calibrations to times at which the workload of processor 103 is below a threshold level. Also, to prevent calibration from consuming limited energy from battery 106, OLED degradation manager 118 may limit calibrations to times at which components of information handling system 102 are powered from AC source 107. Further, to ensure OLED degradation manager 118 performs calibration based on representative physical characteristics of OLED panel 116, OLED degradation manager 118 may limit calibrations to times at which particular applications (e.g., those with higher levels of graphics acceleration) are executing on processor 103.

In these and other embodiments, only particular test windows may be calibrated. For instance, OLED degradation manager 118 may use telemetry data to identify a set of test windows that are proximate to sources of heat in OLED panel 116 and/or are used more frequently than other test windows in displaying images, and limit calibration to those identified sets of test windows. Thus, in some embodiments, OLED degradation manager 118 may calibrate all test windows on a regular periodic basis (e.g., once every three months) but may calibrate particular identified test windows that may be more susceptible to degradation (e.g., those test windows having frequently-used pixels and/or are proximate to heat sources) on a more frequent basis.

In these or other embodiments, OLED degradation manager 118 may at times perform dynamic derating of OLED panel 116. For example, when detecting a large decrease with respect to time in luminosity of a test window, OLED degradation manager 118 may derate the luminosity of test windows of OLED panel 116 to lower than the degraded luminosity still available in OLED panel 116. Such dynamic derating may in some instances cause degradation to appear more linear to a user and/or may reduce a number of instances in which OLED degradation manager 118 may need to correct for non-linear degradation.

Figure 3:
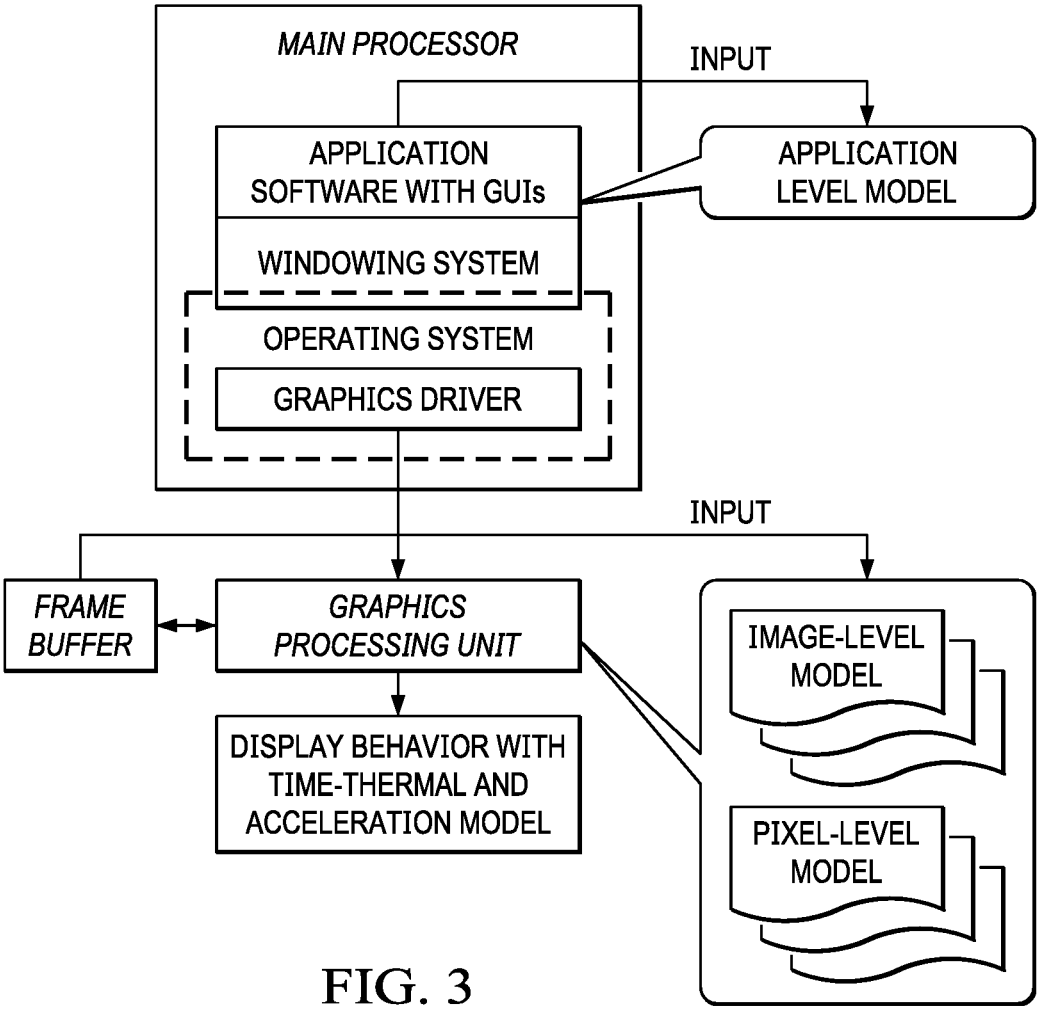
FIG. 3 illustrates a block diagram of selected components that may be used for degradation management of an OLED panel, in accordance with embodiments of the present disclosure.

Although the foregoing contemplates correcting for degradation of OLED panel 116 based on a time-thermal and acceleration model, in some embodiments, OLED degradation manager 118 may correct for degradation of OLED panel 116 based on an application-level model which takes in account degradation of OLED panel 116 as a function of applications executing on information handling system 102. FIG. 3 illustrates a block diagram of selected components that may be used for degradation management of OLED panel 116, including degradation management based on a time-thermal and acceleration model and an application-level model, in accordance with embodiments of the present disclosure.

Figure 4:
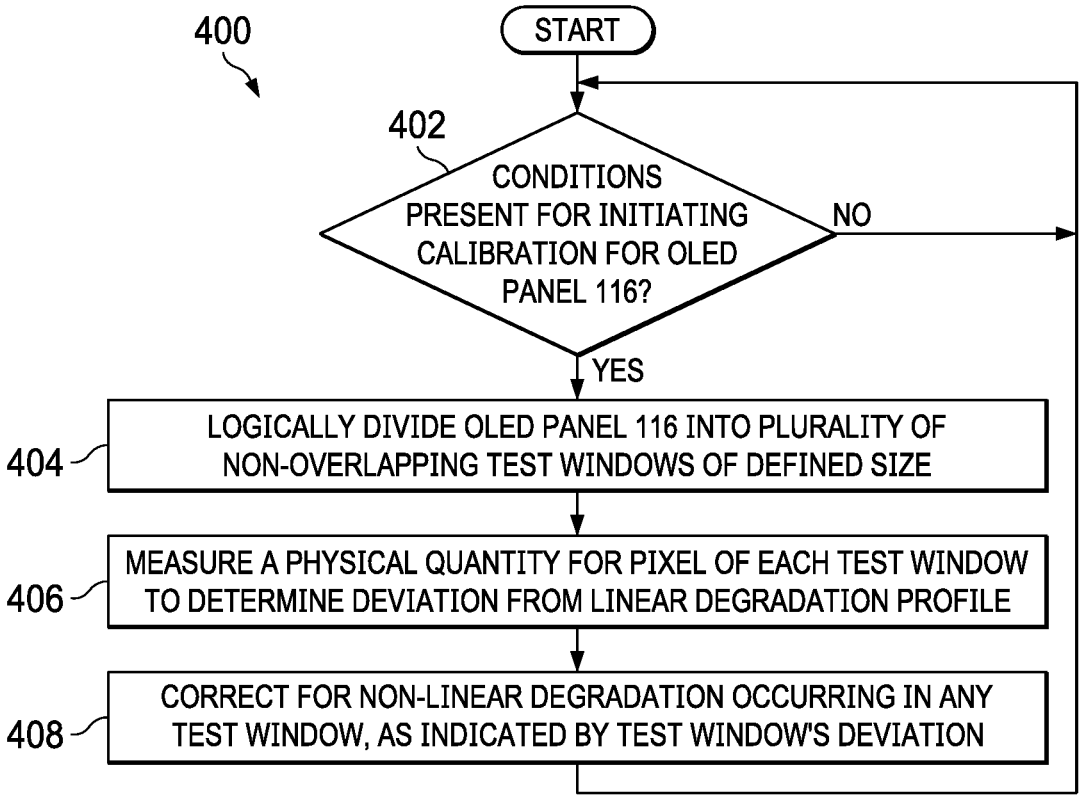
FIG. 4 illustrates a flow chart of an example method for management of degradation of an OLED panel, in accordance with embodiments of the present disclosure.

FIG. 4 illustrates a flow chart of an example method 400 for management of degradation of OLED panel 116, in accordance with embodiments of the present disclosure. According to some embodiments, method 400 may begin at step 402. As noted above, teachings of the present disclosure may be implemented in a variety of configurations of information handling system 102. As such, the preferred initialization point for method 400 and the order of the steps comprising method 400 may depend on the implementation chosen.

At step 402, OLED degradation manager 118 may determine if conditions are present for initiating a calibration for OLED panel 116. Such conditions may include one or more of passage of a period of time, whether components of information handling system 102 are drawing energy from AC source 107, whether the workload of processor 103 is below a threshold, and/or which applications are executing on processor 103. If conditions are present for initiating a calibration of OLED panel 116, method 400 may proceed to step 404.

At step 404, OLED degradation manager 118 may logically divide OLED panel 116 into a plurality of non-overlapping test windows of defined size (e.g., 120 pixels by 120 pixels, 40 pixels by 40 pixels, etc.). In some instances, the sizes of the test windows may decrease over the lifespan of OLED panel 116.

At step 406, OLED degradation manager 118 may measure a physical quantity (e.g., pixel luminosity) for a pixel of each test window (e.g., bottom-right pixel, randomly-selected pixel, etc.), to determine the test window's deviation, if any, from a linear degradation profile. In some instances, OLED degradation manager 118 may measure such physical quantity for all test windows. In other instances, OLED degradation manager 118 may measure such physical quantity for each test window of a subset of the test windows identified to be at greater risk of degradation (e.g., test windows near a source of heat and/or test windows with frequently-used pixels).

At step 408, OLED degradation manager 118 may correct for non-linear degradation occurring in any test window, as indicated by a test window's deviation, if any, from a linear degradation profile. For example, OLED degradation manager 118 may modify a frame buffer for display data to brighten or darken certain areas of an image to account for the non-linear degradation, or may control brightness of OLED panel 116 (e.g., via OLED controller 120), such that each test window of OLED panel 116 displays in accordance with its own brightness level. After completion of step 408, method 400 may proceed again to step 402.

Although FIG. 4 discloses a particular number of steps to be taken with respect to method 400, method 400 may be executed with greater or fewer steps than those depicted in FIG. 4. In addition, although FIG. 4 discloses a certain order of steps to be taken with respect to method 400, the steps comprising method 400 may be completed in any suitable order.

Method 400 may be implemented using information handling system 102, and/or any other system operable to implement method 400. In certain embodiments, method 400 may be implemented partially or fully in software and/or firmware embodied in computer-readable media.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. An information handling system comprising:

a display comprising an organic light-emitting diode (OLED) panel; and an OLED degradation management subsystem configured to, responsive to a condition for initiating a calibration of the OLED panel:

logically divide the OLED panel into a plurality of non-overlapping test windows of a defined size wherein the defined size decreases over a lifecycle of the OLED panel;

obtain a measured value of a physical quantity for a pixel of at least one of the plurality of non-overlapping test windows;

determine a deviation of the at least one test window based on a difference between the measured value and a profile value associated with a linear degradation profile of the physical quantity, wherein the linear degradation profile indicates projected values of the physical property as a function of time; and correct for non-linear degradation occurring in the at least one test window based on the deviation.

2. The information handling system of claim 1, wherein a condition for initiating the correcting includes one or more of a group of conditions, wherein the group of conditions include:

whether a workload of a processor of the information handling system is below a threshold workload; and an identity of one or more applications executing on the processor.

3. The information handling system of claim 1, wherein the physical quantity is a luminosity.

4. The information handling system of claim 1, wherein the OLED degradation management subsystem measures the physical quantity for each of the plurality of non-overlapping test windows.

5. The information handling system of claim 1, wherein the OLED degradation management subsystem measures the physical quantity for each of a subset of the plurality of non-overlapping test windows, wherein the subset is selected based on a determination of which of the plurality of non-overlapping test windows are at a greater risk of degradation.

6. The information handling system of claim 5, wherein the determination of which of the plurality of non-overlapping test windows are at the greater risk of degradation is based on at least one of proximity of the test windows to sources of heat and test windows with pixels having a frequency of use exceeding a threshold frequency.

7. A method comprising:

logically dividing an organic light-emitting diode (OLED) panel into a plurality of non-overlapping test windows of a defined size wherein the defined size decreases over a lifecycle of the OLED panel;

obtaining a measured value of a physical quantity for a pixel of at least one of the plurality of non-overlapping test windows;

determining a deviation of the at least one test window based on a difference between the measured value and a profile value associated with a linear degradation profile of the physical Quantity, wherein the linear degradation profile indicates projected values of the physical property as a function of time; and correcting for non-linear degradation occurring in the at least one test window based on the deviation.

8. The method of claim 7, wherein a condition for initiating the correcting includes one or more of a group of conditions, wherein the group of conditions include:

whether a workload of a processor of the information handling system is below a threshold workload; and an identity of one or more applications executing on the processor.

9. The method of claim 7, wherein the physical quantity is a luminosity.

10. The method of claim 7, further comprising measuring the physical quantity for each of the plurality of non-overlapping test windows.

11. The method of claim 7, further comprising measuring the physical quantity for each of a subset the plurality of non-overlapping test windows, wherein the subset is selected based on a determination of which of the plurality of non-overlapping test windows are at a greater risk of degradation.

12. The method of claim 11, wherein the determination of which of the plurality of non-overlapping test windows are at the greater risk of degradation is based on at least one of proximity of the test windows to sources of heat and test windows with pixels having a frequency of use exceeding a threshold frequency.

13. An article of manufacture comprising:

a non-transitory computer-readable medium; and computer-executable instructions carried on the computer-readable medium, the instructions readable by a processor, the instructions, when read and executed, for causing the processor to:

logically divide an organic light-emitting diode (OLED) panel into a plurality of non-overlapping test windows of a defined size wherein the defined size decreases over a lifecycle of the OLED panel;

obtain a measured value of a physical quantity for a pixel of at least one of the plurality of non-overlapping test windows;

determine a deviation of the at least one test window based on a difference between the measured value and a profile value associated with a linear degradation profile of the physical quantity, wherein the linear degradation profile indicates values of the physical property as a function of time; and correct for non-linear degradation occurring in the at least one test window based on the deviation.

14. The article of claim 13, wherein a condition for initiating the correcting includes one or more of a group of conditions, wherein the group of conditions include:

whether a workload of a processor of the information handling system is below a threshold workload; and an identity of one or more applications executing on the processor.

15. The article of claim 13, wherein the physical quantity is a luminosity.

16. The article of claim 13, the instructions for further causing the processor to measure the physical quantity for each of the plurality of non-overlapping test windows.

17. The article of claim 13, the instructions for further causing the processor to measure the physical quantity for each of a subset the plurality of non-overlapping test windows, wherein the subset is selected based on a determination of which of the plurality of non-overlapping test windows are at a greater risk of degradation.

18. The article of claim 17, wherein the determination of which of the plurality of non-overlapping test windows are at the greater risk of degradation is based on at least one of proximity of the test windows to sources of heat and test windows with pixels having a frequency of use exceeding a threshold frequency.

* * * * *